US005086842A

United States Patent [19]

Cholet

[11] Patent Number: 5,086,842

[45] Date of Patent: Feb. 11, 1992

[54] DEVICE AND INSTALLATION FOR THE CLEANING OF DRAINS, PARTICULARLY IN A PETROLEUM PRODUCTION WELL

[75] Inventor: Henri Cholet, Le Pecq, France

[73] Assignee: Institut Francais Du Petrole, Rueil Malmaison, France

[21] Appl. No.: 578,452

[22] Filed: Sep. 7, 1990

[30] Foreign Application Priority Data

Sep. 7, 1989 [FR] France ..... 8911693

[51] Int. Cl.[5] ..... E21B 37/00

[52] U.S. Cl. ..... 166/312; 15/104.061; 134/22.12; 134/24; 134/167 C

[58] Field of Search ..... 166/312, 222, 223; 15/104.05, 104.061, 104.12; 134/24, 22.12, 32, 33, 167 C, 172, 191, 198

[56] References Cited

U.S. PATENT DOCUMENTS

| | | | |
|---|---|---|---|
| 2,735,794 | 2/1956 | Pletcher | 15/104.12 |
| 4,031,971 | 6/1977 | Miller | 15/104.12 |
| 4,744,420 | 5/1988 | Patterson et al. | 166/312 |
| 4,909,325 | 3/1990 | Hopmann | 166/312 |

*Primary Examiner*—William P. Neuder

*Attorney, Agent, or Firm*—Antonelli, Terry, Stout & Kraus

[57] ABSTRACT

According to one significant characteristic of this invention, the device includes a nozzle (38) for projecting cleaning fluid and connected to a deflector (44) which directs the fluid jet in the direction of the wall of the drain and in particular towards the lower wall of said drain where solid sediments or deposits accumulate. In one embodiment the fluid jet projected by the nozzle (38) and loaded with particles removed from the drain is sucked in via a Venturi effect and the fluid and particles are brought back to the surface.

15 Claims, 5 Drawing Sheets

2
5
46
40
42
44
45
38
36
32
20
34
35
29
48
22
50
52
54
24
56
28
74
22c
22a
68
30
70
26
22b
72
73
64
76
80
78
16
66
62
60
10
17
19
14
82
45b
45a

DEVICE AND INSTALLATION FOR THE CLEANING OF DRAINS, PARTICULARLY IN A PETROLEUM PRODUCTION WELL

FIELD OF THE INVENTION

The present invention concerns equipment and installations for cleaning horizontal drains in petroleum production wells.

BACKGROUND OF THE INVENTION

It is known that the placing in production of wells in sandy deposits with the aid of horizontal drains results in the sand being carried by the fluid flowing from the deposit and in large deposits of sand or other sediments, mainly in the horizontal section of the drains. This results in a considerable decrease in the production of the well.

The U.S. Pat. No. 166/312, 105,106 4,744,420 mentions a known device for cleaning horizontal drains and which includes, at the extremity of the two concentric pipe columns, a body fitted with nozzles for projecting a cleaning liquid, this body delimiting a cleaning fluid feeding passage and connected to said nozzles, as well as a passage for the return of this fluid loaded with solid particles of sand and other sediments, these two passages being respectively connected to one of the two pipes delimited by the two concentric tubes.

In this known device, the nozzles for projecting cleaning fluid are disposed at the extremity of the body and are approximately orientated parallel to the axis of the drain. Such a disposition tends to expel in front of the device the sand and other sediments accumulated in the drain.

It is this particular problem which the invention proposes to resolve so as to carry out an effective cleaning of these horizontal or approximately horizontal drains.

SUMMARY OF THE INVENTION

To this effect, the purpose of the invention is to provide a device for cleaning a horizontal drain or a slightly sloping drain and adapted to be disposed at the downstream extremity of two concentric pipe columns delimiting two pipes, also concentric, this device comprising a body which is provided at its extremity with at least one fluid projection nozzle and which firstly delimits a cleaning fluid feeding passage and secondly a return passage for fluid loaded with solid particles of sand or other sediments, these two passages to be respectively connected to the two pipes delimited by the pipe columns, wherein said device comprises suitable deflecting means to direct the fluid jet coming out of the nozzle or each nozzle in the direction of the wall of the drain.

According to other characteristics of the present invention:

The deflector is disposed so as to orientate the fluid jet towards the bottom;

The deflector is joined onto a support secured to the downstream section of the body;

The fluid feeding passage comprises from upstream to downstream inside the body a ring-shaped pipe, at least one radial passage and one axial pipe, and the fluid return passage loaded with particles comprises from downstream to upstream at least one pipe extending from the lateral wall of the front section of the body, at least one longitudinal pipe, one ring-shaped pipe encompassing a working fluid injector and one axial pipe;

The ring-shaped pipe and the axial pipe of the return passage form a venturi tube which, along with the injector, form a sucking device;

The injector is fed with working fluid from the radial passage and the axial pipe of the feeding passage, the fluid flow being distributed inside the axial pipe into two opposing flows respectively directed towards the nozzle and the injector.

The body is connected at its rear or upstream section to a connector comprising two sets of pipes which communicate respectively an upstream axial pipe with a downstream ring-shaped pipe and an upstream ring-shaped pipe with a downstream axial pipe.

The object of the invention is also to embody an installation comprising such a device and is further characterized in that it includes a connection box divided into two chambers connected at their upstream section to two pipe columns disposed side by side and at their downstream section to the two concentric pipe columns.

BRIEF DESCRIPTION OF THE DRAWINGS

The invention shall now be described in full detail with reference to the accompanying drawings, given solely by way of examples, in which.

DETAILED DESCRIPTION OF THE PREFERRED EMBODIMENTS

Figures 1, 2, 3, 4, 5:
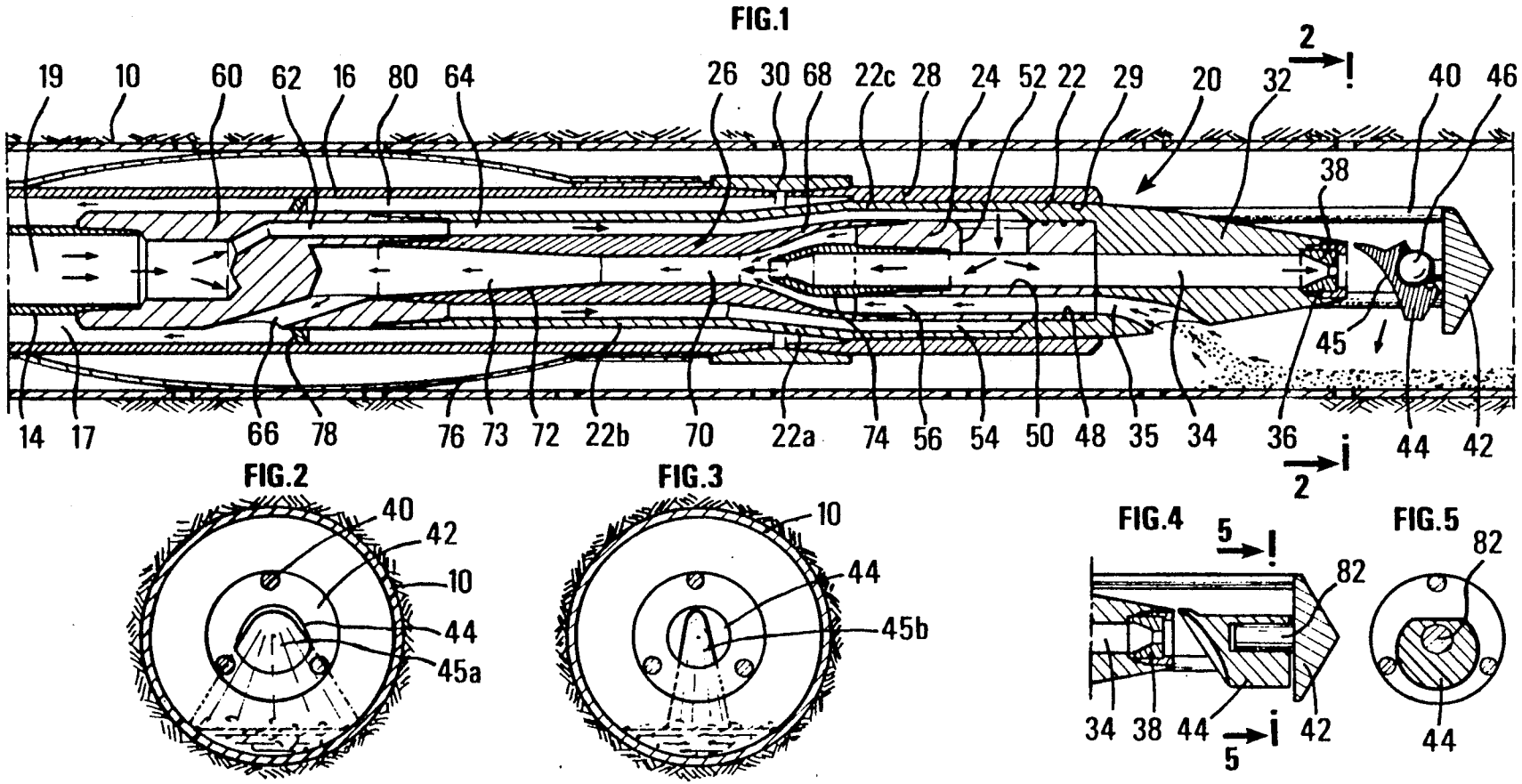
FIG. 1 is a longitudinal cutaway view of a device according to the invention.
FIG. 2 is a cutaway view along the line 2—2 of FIG. 1.
FIG. 3 is a cutaway view similar to that of FIG. 2 of one embodiment variant.
FIG. 4 is a longitudinal partial cutaway view of one embodiment variant.
FIG. 5 is a cutaway view along the line 5—5 of FIG. 4.
Figure 6:
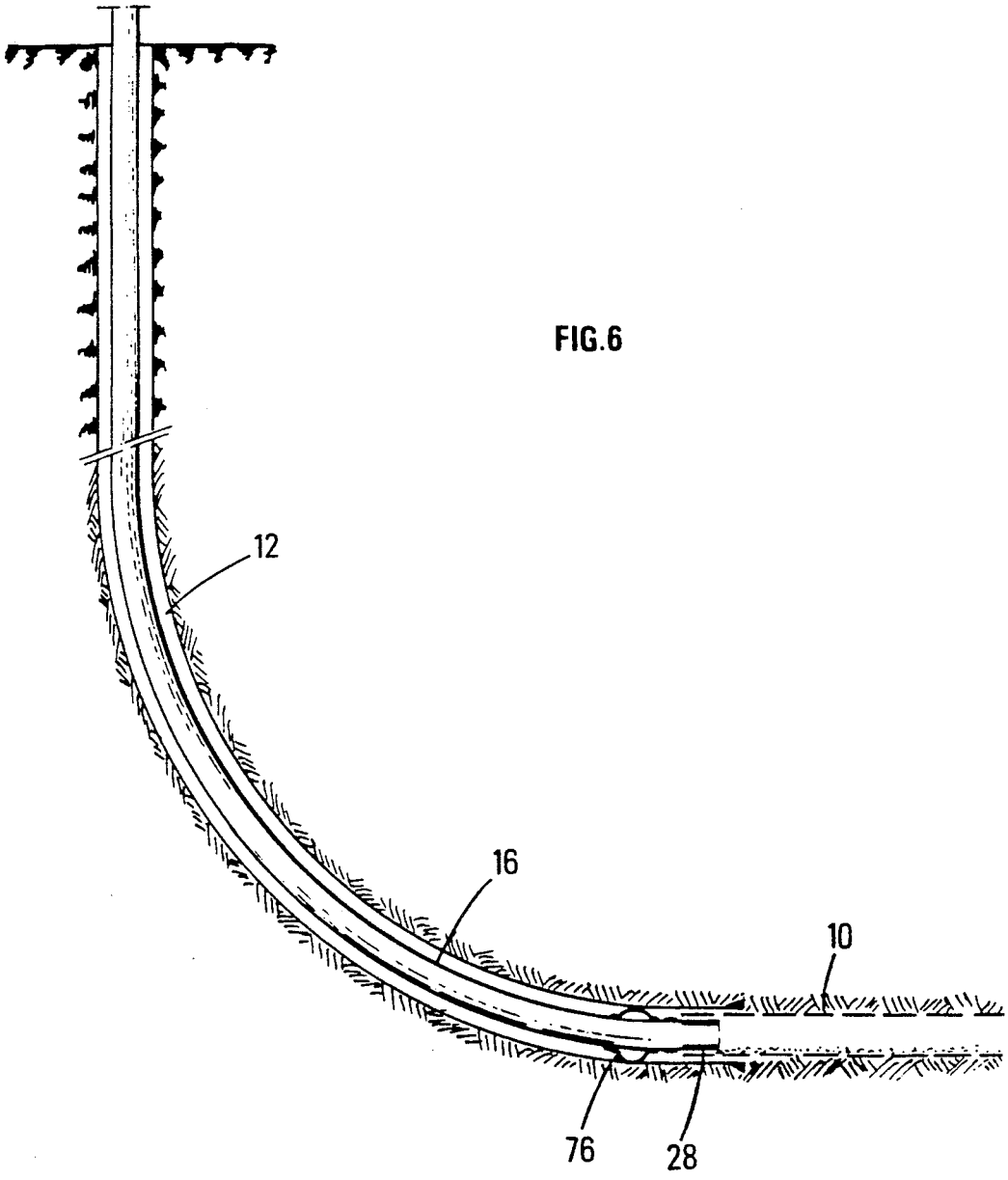
FIGS. 6, 7 and 8 are three diagrammatical views showing three successive phases for the implementation of an installation according to the invention.

FIG. 1 shows a horizontal or roughly horizontal drain section 10 connected a main pipe column 12 (FIG. 6).

Two concentric pipe columns 14 and 16 are disposed in this drain delimiting between them a ring-shaped pipe 17, whereas the internal pipe column 14 is situated standing back with respect to the downstream extremity of the external pipe column, the device of the invention being disposed between these two extremities.

This device includes a body 20 embodied by several sections—in this case three—disposed so as to carry out several functions to be described hereafter in detail. These three sections are: an external section 28, a front central section 22 and a rear central section 26.

The external section 22 is received in a sheath 28 whose internal surface has preferably a truncated shape, this sheath being fixed by any suitable means to the extremity of the pipe column 16, for example by means of a collar 30.

This external section is hollow and comprises at its extremity directed towards downstream of the device a head 32 projecting with respect to the sheath which is pierced with an axial pipe 34 and three pipes separated from 34 and which open into the lateral wall of the head 32. The pipes 35 are disposed 120' with respect to each other. According to the size of the device, a larger number of such pipes may be provided, such as 6. The pipe 34 opens into a housing 38 into which a fluid projecting nozzle 38 is fitted.

The three braces 40 and a support 42 for a deflector 44 situated opposite the nozzle 38 are secured by linking members to this same head. In the embodiment represented on FIG. 1, the deflector 44 is mounted on a pot type or ball and socket joint 46 and exhibits a sufficient unbalance so as to occupy a specific position with respect to the adjacent drain, the concave wall 45 of this deflector being directed towards the lower wall of the drain.

As shown on FIGS. 2 and 3, this concave wall 45*a* 45*b* may assume various shapes, depending on whether a wide jet (FIG. 2) or narrower jet (FIG. 3) is desired.

At the rear of the pipe 34, the portion 22 of the body comprises a housing 48 receiving the central section 24 of the body which delimits firstly a traversal axial pipe 50 disposed in the prolongation of the pipe 34, at least one radial passage 52 communicating this central pipe with a ring-shaped pipe 54 delimited between the central sections of the body and the external section, and at least one longitudinal pipe 56, which forms part of the return passage of the fluid loaded with solid particles. In the embodiment shown, three pipes are provided 56 in the prolongation of the three pipes 35.

In going back up to the rear, the external portion of the body exhibits a tubular shape with a truncated intermediate portion 22*a* and two cylindrical extremity sections 22*b*, 22*c*, the extremity section 22*b* with the smallest diameter being connected to the internal pipe column 14 by a connector 60.

The latter comprises two sets of pipes:

a first set of three pipes 62 which ensure communication between the inside 19 of the pipe column 14 and a ring-shaped pipe 64 delimited between the external section of the body and the rear central section 26 of this body;

a second set of three pipes 66 ensuring communication between the ring-shaped gap 17 delimited between the two pipe columns and the axial pipe 73 of the body.

The rear central section 26 of the body is fixed firstly to the internal downstream extremity of the connector 60 and secondly secured to the external wall of the front central body 24. The section 26 forms a venturi pipe and delimits a converging cone 68, a neck 70 and then a diverging cone 72 so as to form with an injector 74 fixed in the central body a sucking device whose function shall be specified later.

The external pipe column is kept in the drain 10 by a known elastic centering device.

In addition, a trough 78 is inserted between the external pipe column 16 and the connector 60 so as to avoid sand and other solid particles being deposited at the extremity of the ring-shaped or annular gap 80 delimited between the body and external pipe column.

This device functions as follows:

The internal pipe column 14 is fed with fluid, in this case water, from the surface. This fluid coming into the connector 60 passes from the axial pipe 19 to the ring-shaped pipe 64 delimited between the external and central sections of the body so as to finally arrive at the radial passage 52.

Once it has arrived inside the axial pipe 50, the working fluid is divided into two flows, one directed towards the nozzle 38 and the other towards the injector 74. The respective sections of the nozzle and the injector are selected so as to obtain a determined distribution of the flow rate, which may be for example 3/5th of the incident flow rate in the direction of the injector and 2/5th in the direction of the nozzle 38.

The fluid jet emitted by the nozle 38 is deviated by the deflector 44 towards the lower wall of the drain and provokes a thorough agitation of the solid particles of sand or other sediments accumulated inside the drain. The fluid loaded with these particles is sucked at the level of the pipe 35, this sucking effect being provoked inside the venturi pipe 68–72 by the second flow of working liquid emitted by the injector 74. The working fluid and the liquid loaded with particles mix together in the section 70, 72 of the body and are directed towards the surface in traversing the connector 60 by the pipes 66 and by passing through the ring-shaped pipe 17 delimited between the two pipe columns.

The presence of a single nozzle and a deflector orientating the fluid jet towards the drain have the effect of concentrating the jet energy towards the sandy deposit and considerably improve effectiveness.

Furthermore, the concave shape of the deflector enables the jet to be given an optimal shape, depending on the extent and consistency of the sandy deposits. In this respect, it may be noted that this deposit is often rendered consistent by the deposits of hydrocarbons, which increases the effect of energy concentration obtained by the device of the invention.

It is also advantageous to use a ring-shaped pipe for the return of fluid loaded with particles since the section available is much larger.

FIGS. 4 and 5 show one variant for mounting the deflector, wherein the pot type joint of FIG. 1 is replaced by a mounting around an axis 82 on which the deflector is mounted oscillating.

In this respect, one could add that the unbalance of the deflector may be obtained by different means such as the dissimmetrical shape of the deflector, slightly dissimmetrical of the latter or by the use of materials of different densities.

More generally, the device may be embodied in a large number of other variants, both as regards the embodiment of parts comprising it and as regards the number and disposition of the various intake and cleaning fluid return pipes.

There now follows a description in relation to the other figures of an installation integrating the device mentioned above, as well as an operational mode.

FIG. 6 represents a main pipe column 123 which extends from the surface and which comprises an approximately vertical section and then a curved section so as to be extended by the approximately horizontal drain 10.

Firstly, the external pipe column 16 fitted with its centering device 76 and carrying the sheath 28 at its extremity is inserted into this main pipe column.

Figure 7:
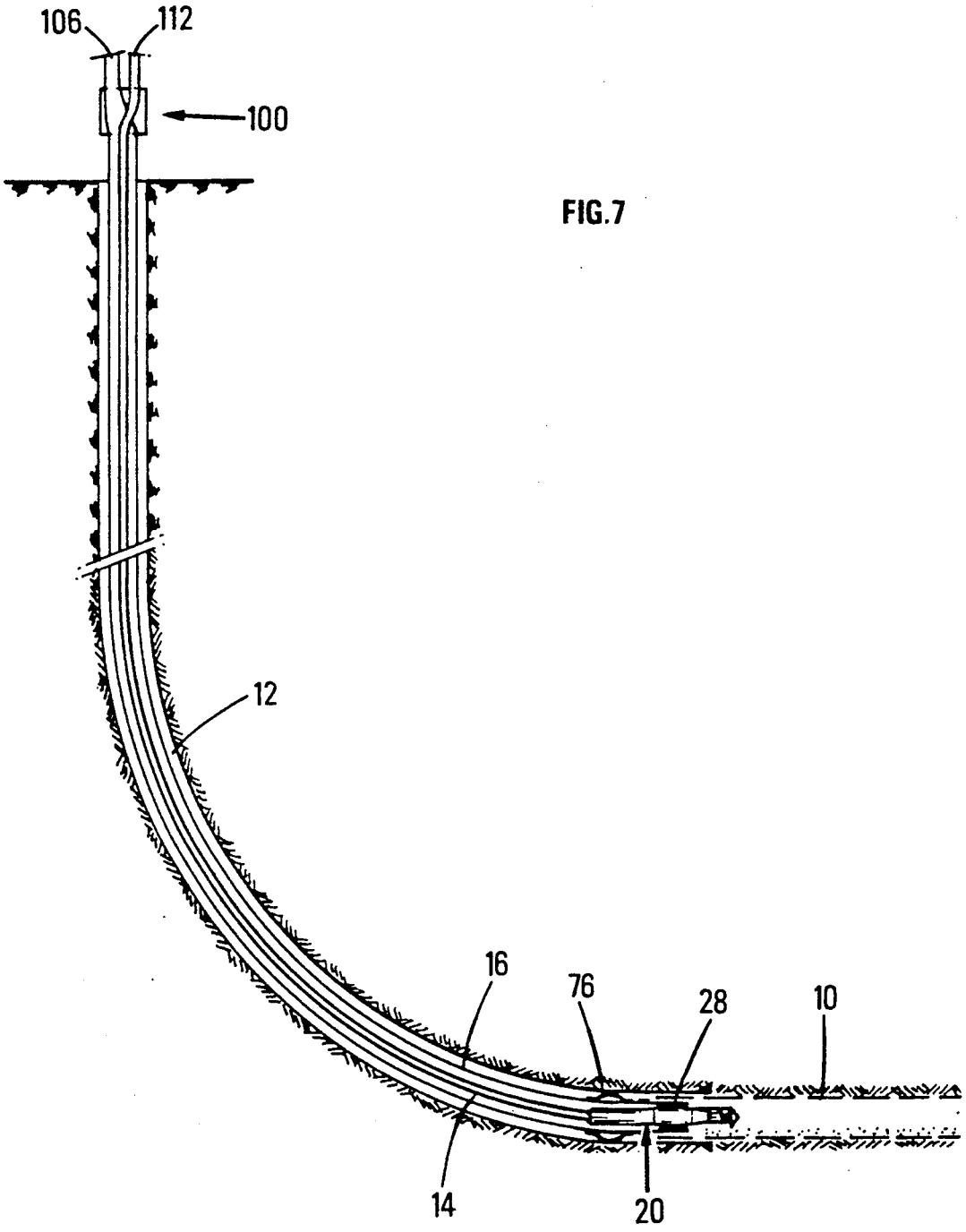

Then, as shown on FIG. 7, the internal pipe column 14 carrying at its extremity the actual device, which rests on the seat constituted by the sheath 28, is lowered into the inside of the pipe column 16.

As this is known in the technique, the pipe columns 14 and 16 may be formed of either rigid tubes screwed together or of continuous elements unwound from the surface.

The installation may, of course, be completed by connecting the internal pipe column to a pump supplying water under a suitable pressure and by connecting the pipe column to known means for extracting the liquid loaded with particles.

However, according to one additional characteristic of the invention, a connection box 100 is used for this purpose so as to make it possible to move from a concentric position of the pipe columns 14, 16 downstream from this box to a side by side disposition upstream of said box.

Figure 9:
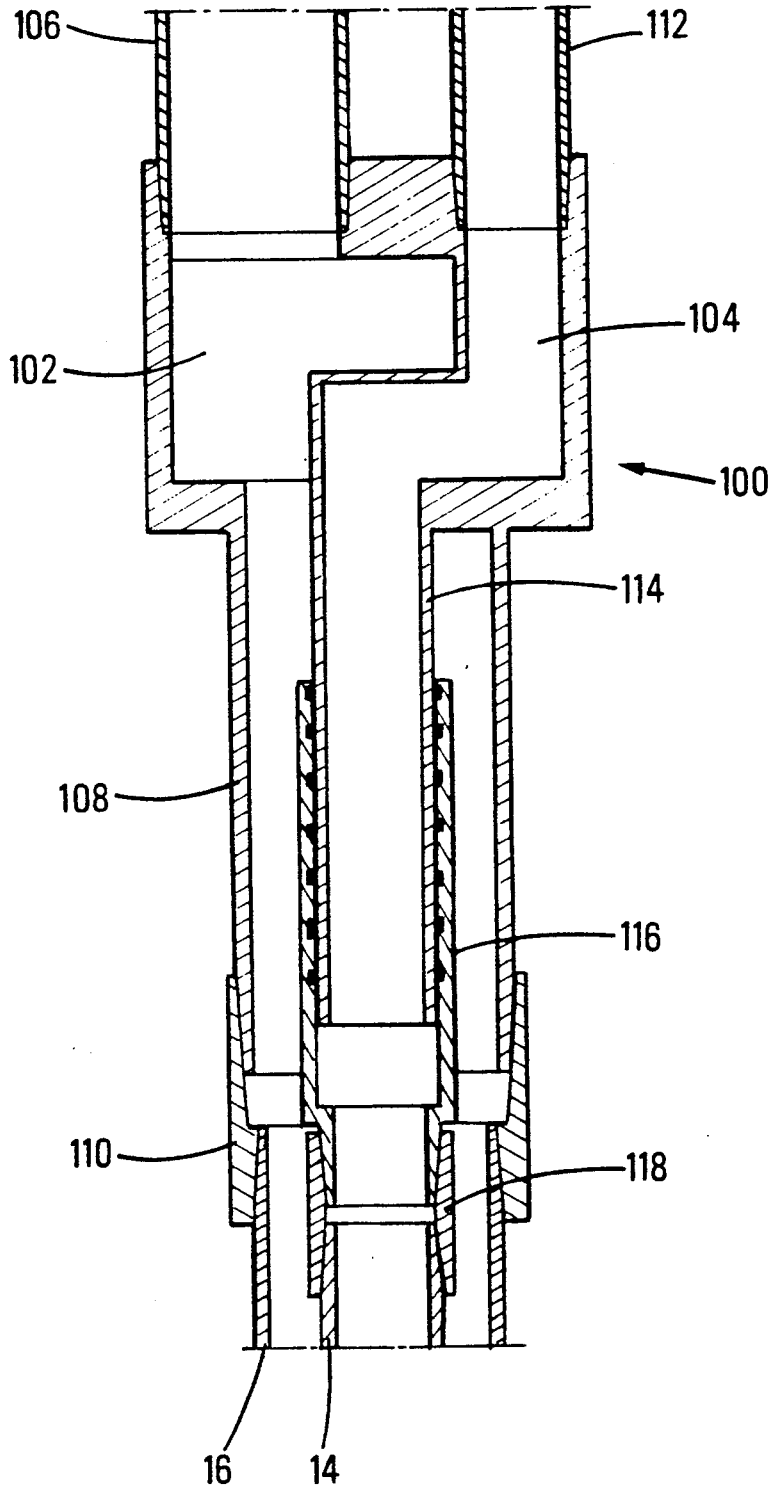
FIG. 9 is a cutaway detailed view of a connection box used in such an installation.

This result is obtained by means of the disposition shown on FIG. 9 which clearly shows that the connection box 100 is divided into two chambers 102, 104 whose first chamber 102 may have its upper section connected to a pipe column 106 whose section corresponds to the section of the annular gap between the two concentric pipe columns 14 and 16, whereas it opens at its lower extremity into a tube section 108 able to be connected by a connector 110 to the upper section of the external pipe column 16.

FIG. 9 is a skeleton diagram, the shapes being in actual fact adapted so as to ensure that a proper flow is obtained.

The second chamber 104 is connected at its upper section to the pipe column 112 with the same section as the internal pipe column 14, whereas at its lower section it opens into a tube section 114 which may be connected to the internal pipe column 14, either by a single connector if the two internal and external pipe columns are approximately at the same level, or preferably by a sleeve 116 and a connector 118, if as this is generally the case, the two concentric pipe columns are of different lengths.

Figure 8:
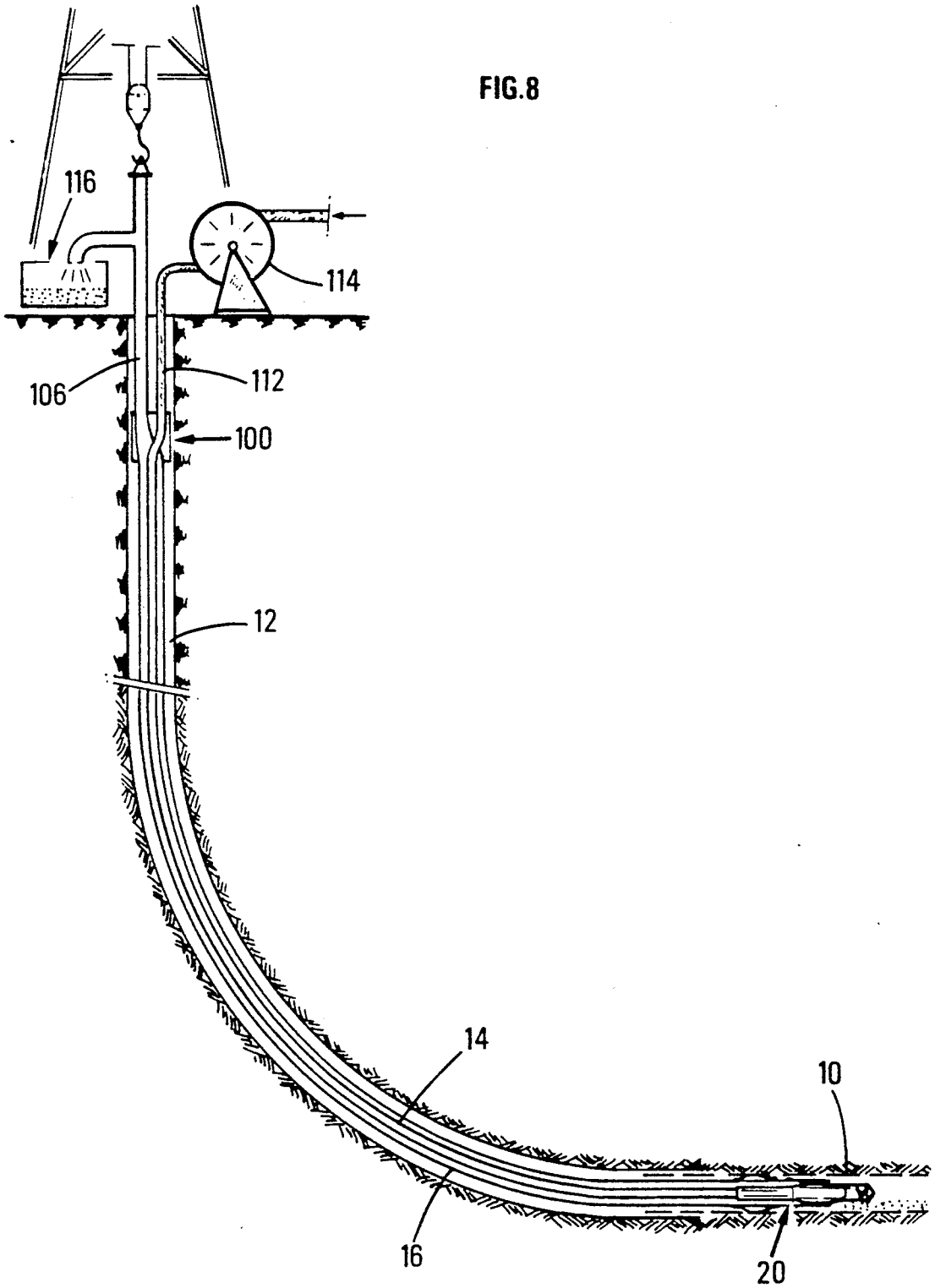

Such a disposition is shown on FIG. 8 where one can see that the connection box 100 is lowered into the main pipe column, the additional pipe column elements 106 and 112 being added to the upper portion of this box when the device is to be moved into the drain. The pipe column 112 is connected to a pump 114 and the pipe column 106 is connected to a sloughing-off box 116.

Such a disposition is particularly advantageous since it facilitates the joining of additional pipe columns, the side-by-side disposition being in this respect much more advantageous than the concentric disposition.

Furthermore, the device of the invention exhibits great flexibility as regards use and adaptation. In effect, if one wishes to carry out an operation for the peripheral cleaning of the main pipe column or drain, the orientable or articulated deflector can be replaced by a fixed deflector disposed approximatively perendicular to the axial jet and which projects the fluid over an angle of 360°.

The pipes 35 may have, particularly, an axial direction.

The direction of these pipes 35 as well as the distance separating them from the deflector 44 may be determined for enabling an efficient cleaning of the wall of the drain.

What is claimed is:

1. Device for cleaning a horizontal or slightly sloping drain adapted to be disposed in the drain at the downstream extremity of two concentric pipe columns delimiting two pipes, also concentric, said device including a body which is provided at its extremity with at least one nozzle for projecting fluid and which delimits firstly a cleaning fluid feeding passage and secondly a return passage for the fluid loaded with solid particles of sand and other sediments, said two passages being adapted to be respectively connected to the two pipes delimited by the pipe columns, wherein said device further comprises deflector means for directing a fluid jet projecting out of the at least one nozzle in a direction toward a wall of the drain on which the solid particles of sand and other sediments accumulate.

2. Device according to claim 1, wherein the deflector is disposed in front of the nozzle to direct the fluid jet downwardly towards a lower wall of the drain.

3. Device according to any one of claims 1 and 2, wherein the deflector is joined onto a support secured to a downstream portion of the body.

4. Device according to claim 3, wherein the deflector is mounted onto the support by means of a ball and socket.

5. Device according to claim 3, wherein the deflector is mounted onto the support in order to oscillate around an axis.

6. Device according to claim 3, wherein the deflector exhibits an unbalance and tends to occupy a specific position with respect to its support.

7. Device according to claim 1, wherein the fluid feeding passage includes from upstream to downstream in the body a ring-shaped pipe, at least one radial passage and one axial pipe, and the return passage of the fluid loaded with particles includes, from downstream to upstream, at least one pipe extending from the lateral wall of the front portion of the body, at least one longitudinal pipe, one ring-shaped pipe encompassing a working fluid injector and one axial pipe.

8. Device according to claim 7, wherein the ring-shaped pipe and the axial pipe forms a venturi pipe which, together with the injector, forms a sucking device.

9. Device according to any one of claims 7 and 8, wherein the injector is fed with working fluid from the radial passage and the axial pipe, the fluid flowrate being distributed in the axial pipe into two opposing flows respectively directed towards the nozzle and the injector.

10. Device according to claim 9, wherein the passage section of the injector is longer than that of the nozzle.

11. Device according to any one of claims 1, 2, 7 or 8, wherein the body is connected at its rear or upstream portion to a connector comprising two sets of pipes which respectively communicate an upstream axial pipe with a downstream ring-shaped pipe and an upstream ring-shaped pipe with a downstream axial pipe.

12. Installation for cleaning horizontal or slighly sloping drains, especially in petroleum production wells, and comprising: two concentric pipe columns delimiting two concentric pipes; a device for projecting a cleaning fluid and removing this fluid loaded with particles; cleaning fluid feeding means and means for removing the loaded fluid, these means being disposed on the surface and respectively connected to one of said concentric pipes, wherein the device is as defined in claim 1.

13. Installation according to claim 12, wherein the cleaning fluid feeding means are connected to the pipe delimited by the internal pipe column.

14. Installation according to any one of claims 12 to 13, wherein includes a connecting box divided into two chambers connected at their downstream portion to two pipe columns disposed side by side and at their upstream portion to two concentric pipe columns.

15. Installation according to claim 14, wherein the connecting box is connected to at least one of the concentric pipe columns by means of an intermediate sleeve.

* * * * *